US009093742B2

(12) United States Patent
Choiniére et al.

(10) Patent No.: US 9,093,742 B2
(45) Date of Patent: Jul. 28, 2015

(54) WIDE SCAN STEERABLE ANTENNA WITH NO KEY-HOLE

(71) Applicants: Eric Choiniére, Ottawa (CA); Aiping Liang, Dollard-DesOrmeaux (CA); Richard Horth, Kirkland (CA); Philippe Loiselle, Montréal (CA)

(72) Inventors: Eric Choiniére, Ottawa (CA); Aiping Liang, Dollard-DesOrmeaux (CA); Richard Horth, Kirkland (CA); Philippe Loiselle, Montréal (CA)

(73) Assignee: McDonald, Dettwiler and Associates Corporation, St. Anne-de-Bellevue, Quebec (CA)

( * ) Notice: Subject to any disclaimer, the term of this patent is extended or adjusted under 35 U.S.C. 154(b) by 226 days.

(21) Appl. No.: 13/652,680

(22) Filed: Oct. 16, 2012

(65) Prior Publication Data

US 2014/0104125 A1 Apr. 17, 2014

(51) Int. Cl.

| | |
|---|---|
| ***H01Q 3/08*** | (2006.01) |
| ***H01Q 3/18*** | (2006.01) |
| ***H01Q 1/28*** | (2006.01) |
| ***H01Q 19/13*** | (2006.01) |
| ***H01Q 19/19*** | (2006.01) |

(52) U.S. Cl.
CPC . *H01Q 3/08* (2013.01); *H01Q 3/18* (2013.01); *H01Q 19/134* (2013.01); *H01Q 19/19* (2013.01); *H01Q 1/28* (2013.01)

(58) Field of Classification Search
CPC ..... H01Q 1/288; H01Q 1/193; H01Q 1/125; H01Q 3/02; H01Q 3/08; H01Q 3/12; H01Q 3/16; H01Q 3/18; H01Q 3/20
USPC ..... 343/757, 761, 765, 781 P, 840
See application file for complete search history.

(56) References Cited

U.S. PATENT DOCUMENTS

| | | | | |
|---|---|---|---|---|
| 3,793,637 | A * | 2/1974 | Meek | 343/761 |
| 5,844,527 | A * | 12/1998 | Takashima et al. | 343/781 P |
| 6,198,452 | B1 * | 3/2001 | Beheler et al. | 343/757 |
| 6,262,689 | B1 | 7/2001 | Yamamoto et al. | |
| 6,285,338 | B1 * | 9/2001 | Bai et al. | 343/882 |
| 6,492,955 | B1 | 12/2002 | Amyotte et al. | |
| 6,747,604 | B2 | 6/2004 | Amyotte et al. | |

* cited by examiner

*Primary Examiner* — Robert Karacsony
*Assistant Examiner* — Daniel J Munoz
(74) *Attorney, Agent, or Firm* — Equinox IP; Franz Bonsang

(57) ABSTRACT

A steerable antenna architecture, or configuration, for optimal steering of transmitting and/or receiving beam over wide scan angles, is capable of steering the beam on a full hemisphere (2π steradians), with no singularity or key-hole within a coverage area and with only one RF rotary joint. The architecture includes a dual-reflector assembly defining an antenna focal point located close to a main reflector surface and a signal feed chain having a signal source located adjacent to the antenna focal point and defining a feed axis substantially pointing towards a sub-reflector intersection point. A first actuator rotates the feed chain and the dual-reflector assembly about a first rotation axis generally perpendicular to the feed axis and not intersecting with the coverage area. A second actuator rotates one of the main reflector and the dual-reflector assembly about a second rotation axis aligned with the feed axis.

5 Claims, 5 Drawing Sheets

WIDE SCAN STEERABLE ANTENNA WITH NO KEY-HOLE

CROSS-REFERENCE TO RELATED APPLICATIONS

This application claims priority of U.S. Provisional Application for Patent No. 61/627,710 filed Oct. 17, 2011, the content of which is incorporated herein by reference in its entirety.

FIELD OF THE INVENTION

The present invention relates to the field of antenna systems, and is more particularly concerned with steerable antennas for transmitting and/or receiving electromagnetic signals.

BACKGROUND OF THE INVENTION

It is well known in the art to use steerable (or tracking) antennas to communicate with a relatively moving target over a wide scan angle. Especially in the aerospace industry, such steerable antennas preferably need to have high gain, low mass, and high reliability. The antennas used in these wide scan applications typically include two rotation axes requiring two rotary joints, cable cassettes or other means of propagating the signal over each of the rotation axis. The elimination or the reduction of the number of RF (radio-frequency) rotary joints is highly desirable from a cost, signal loss and reliability perspective. Some solutions have been developed to eliminate rotary joints in wide angle (essentially greater than 90 degrees) steerable antennas but they are affected by the presence of a singularity which affects the ability to track a target when the beam becomes substantially aligned with one of the rotation axes. This singularity is referred to as the key-hole effect, because of the time required for the rotation around the axis presenting a singularity to catch up with the target rate of motion. Generally for satellite based systems, this singularity is associated with the use of an azimuth rotation axis that points to the earth (sub-satellite point or nadir). For certain missions, this singularity has little impact on the overall system performance or complexity but in many cases, especially when a high gain is required, it can lead to very high actuator speed in order to maintain an adequate link as the targets gets aligned with a rotation axis. For a steerable antenna equipped with a nadir pointing azimuth rotation axis, this happens when the sub-satellite track makes a pass very near the intended target. This can become a driver in the choice of the actuator and increase the complexity of the drive electronics system. Larger rotary actuators with more complex and costly drive electronics are then required. A solution having no rotary joints is illustrated in FIG. 1 (ref U.S. Pat. No. 6,747,604). This configuration has a key-hole or singularity at nadir (pointing towards the Earth center for an antenna mounted on an Earth facing panel of an orbiting spacecraft) since one of the rotation axis is pointing towards nadir. A different configuration using an elevation over azimuth gimbal is shown in FIG. 2. This approach has only one rotary joint but also suffers from the key-hole effect at nadir.

Accordingly, there is a need for an improved steerable antenna configuration.

SUMMARY OF THE INVENTION

It is therefore a general object of the present invention to provide an improved steerable antenna architecture, or configuration, for optimal steering of transmitting and/or receiving beam over wide scan angles, essentially greater than 90 degrees.

An advantage of the present invention is that the architecture is capable of steering the beam on almost a full hemisphere ($2\pi$ steradians).

Another advantage of the present invention is that there are no singularities or key-holes within the coverage area, therefore avoiding the need for high speed actuation of the rotary actuators and the associated complexity and cost.

A further advantage of the present invention is that antenna architecture requires only a single RF signal rotary mechanism such as RF rotary joint or flex waveguide or flexible RF cable, therefore improving the reliability of the antenna system.

Still another advantage of the present invention is that the geometry of the antenna can be optimized to minimize the mass and size of the antenna moving parts.

Still another advantage of the present invention is that the stowed and dynamic envelope of the antenna can be optimized.

Yet another advantage of the present invention is that the shape of the reflectors, their relative position as well as their orientation can be optimized to provide the best mass, moving mass, stowed volume and swept volume. The beam generated by the main reflector does not have to be orthogonal to the axis defined by the feed source phase center and the center of the sub-reflector (feed axis). The angle of the beam with the feed axis should however be at least half of the angular width of the coverage area taken along the direction of its narrowest dimension.

According to an aspect of the present invention there is provided a transmitting and/or receiving steerable antenna configuration for optimal beam steering of an electromagnetic signal over wide scan angles within a pre-determined coverage area of the antenna, said antenna configuration comprising:

- a sub-reflector and main reflector assembly defining an antenna focal point located substantially adjacent to a reflecting surface of a main reflector;
- a transmitting and/or receiving signal feed chain having a signal source located adjacent to the antenna focal point and defining a feed axis substantially pointing towards a sub-reflector intersection point, the main reflector generating a signal beam having a beam axis defining a beam angle with the feed axis;
- a first rotation member rotating the feed chain and the sub-reflector and main reflector assembly about a first rotation axis generally perpendicular to the feed axis and not intersecting with the coverage area; and
- a second rotation member rotating one of the main reflector and the sub-reflector and main reflector assembly relative to the signal feed chain about a second rotation axis substantially aligned with the feed axis, the second rotation member being rotated by the first rotation member.

Conveniently, the beam angle is at least half of an angular width of a narrowest dimension of the pre-determined coverage area defining a narrowest angular width of the coverage area.

In one embodiment, the sub-reflector intersection point is located adjacent a geometrical center of a sub-reflector of the assembly.

Conveniently, the main reflector surface and a surface of a sub-reflector of the assembly are corresponding sections of respective conical function surfaces.

Typically, at least one of the main reflector surface and the sub-reflector surface is shaped so as to achieve a signal gain pattern of the antenna assembly for substantially matching a predetermined signal gain pattern.

Other objects and advantages of the present invention will become apparent from a careful reading of the detailed description provided herein, within appropriate reference to the accompanying drawings.

BRIEF DESCRIPTION OF THE DRAWINGS

In the annexed drawings, like reference characters indicate like elements throughout.

DETAILED DESCRIPTION OF THE PREFERRED EMBODIMENTS

With reference to the annexed drawings the preferred embodiments of the present invention will be herein described for indicative purpose and by no means as of limitation.

Figure 1:
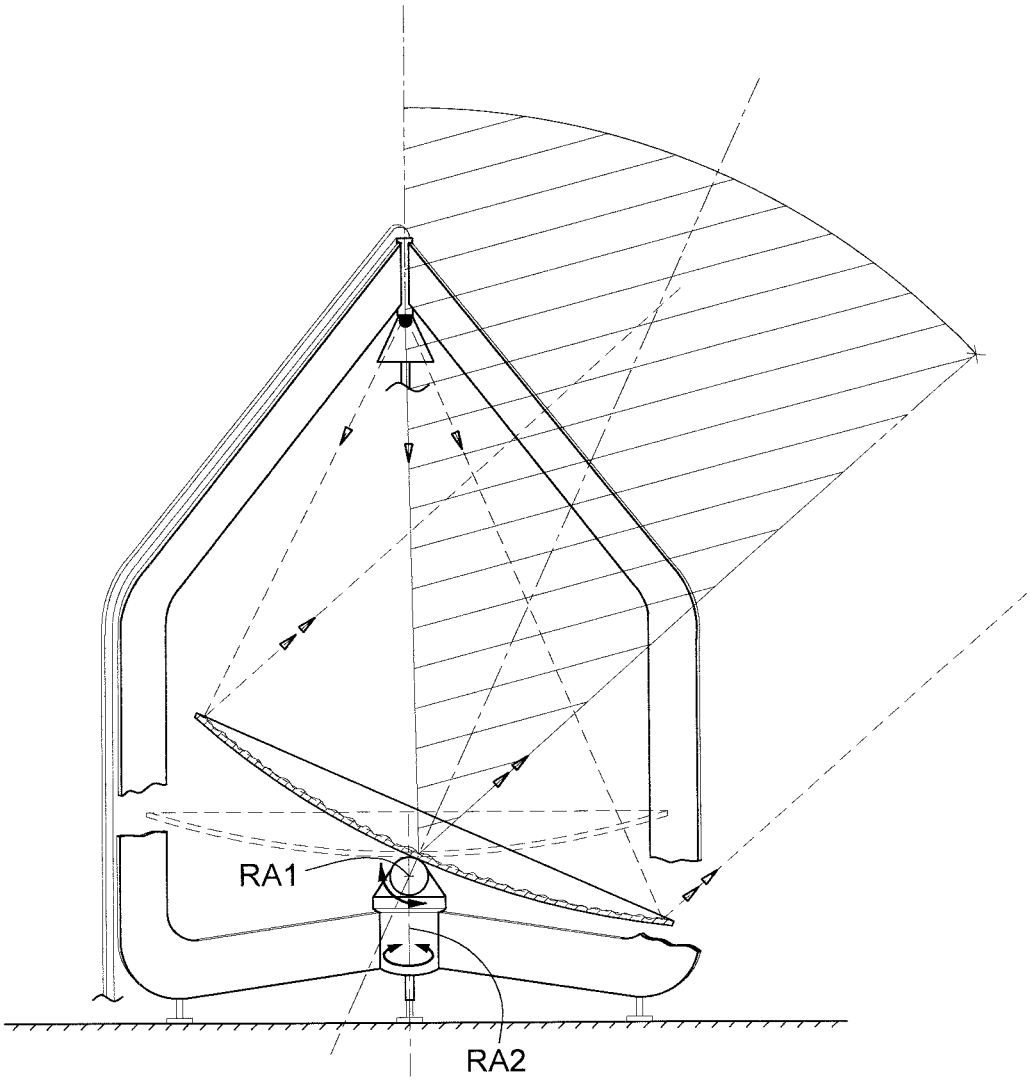
FIG.1 PRIOR ART
FIG. 1 is a top perspective view of a prior art steerable antenna with no rotary joint and a key-hole singularity.
Figure 2:
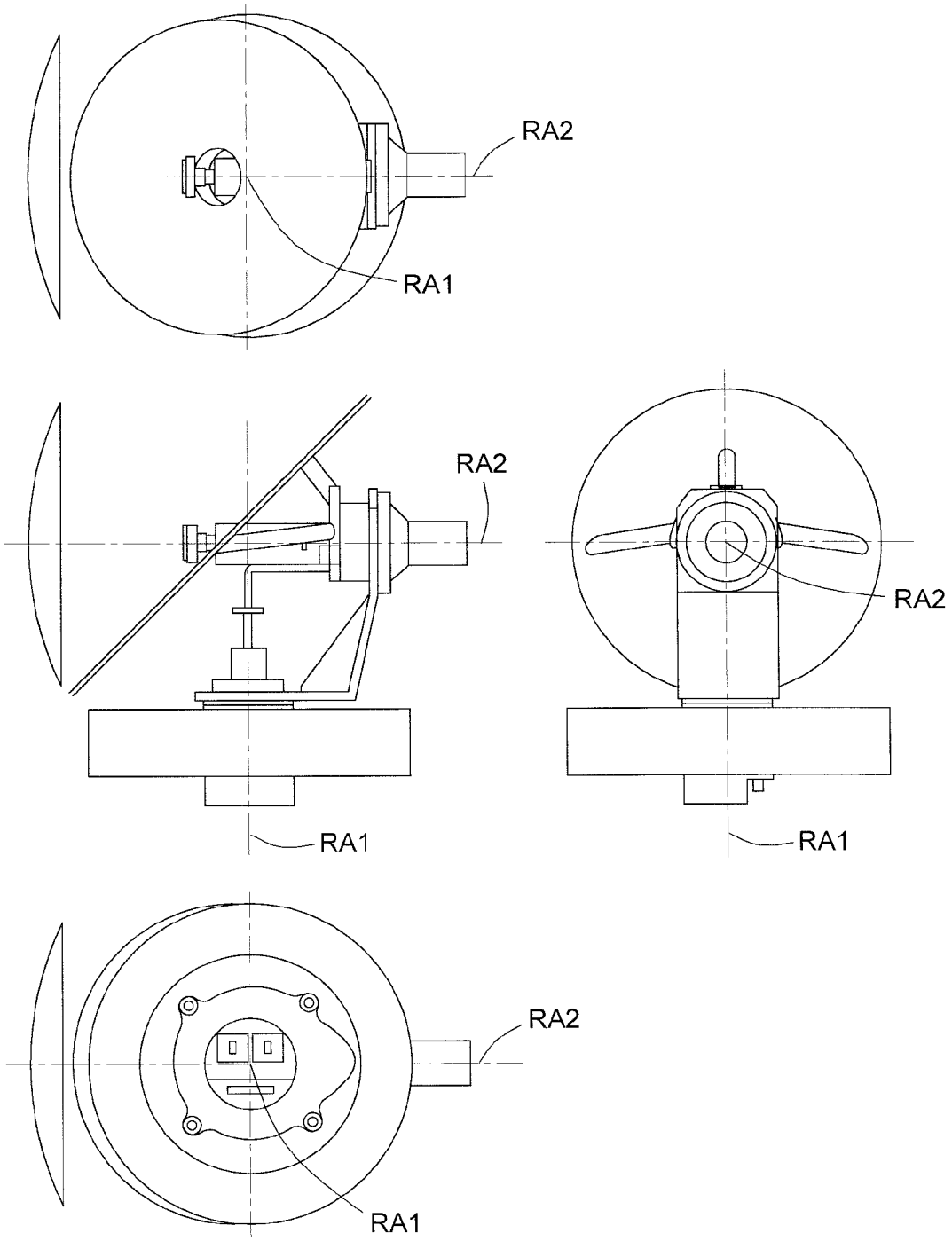
FIG.2 PRIOR ART
FIG. 2 are top plan, front elevation, side elevation and bottom plan views of a prior art steerable antenna with one rotary joint and a key-hole singularity.
Figure 3:
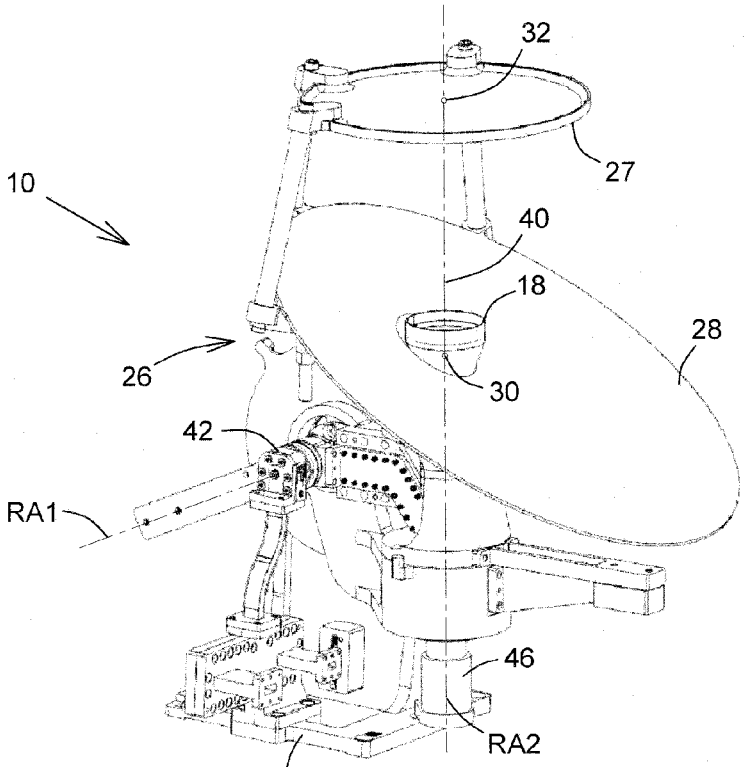
FIGS. 3 and 3*a* are a top perspective view and a side elevation view, respectively, of a steerable antenna in accordance with an embodiment of the present invention, with no key-hole singularity.
Figure 3A:
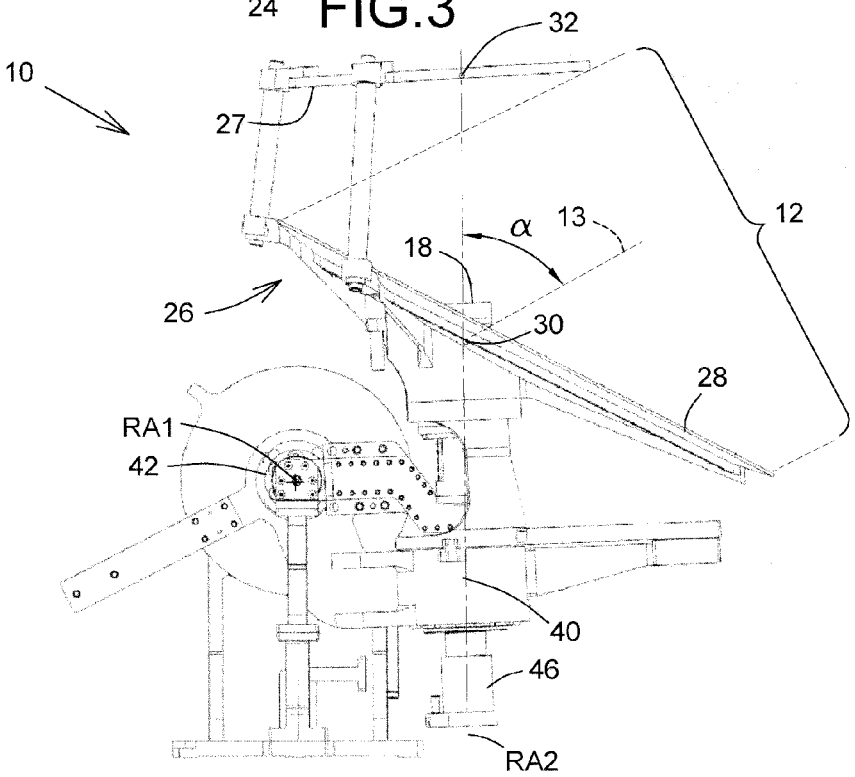
Figure 7:
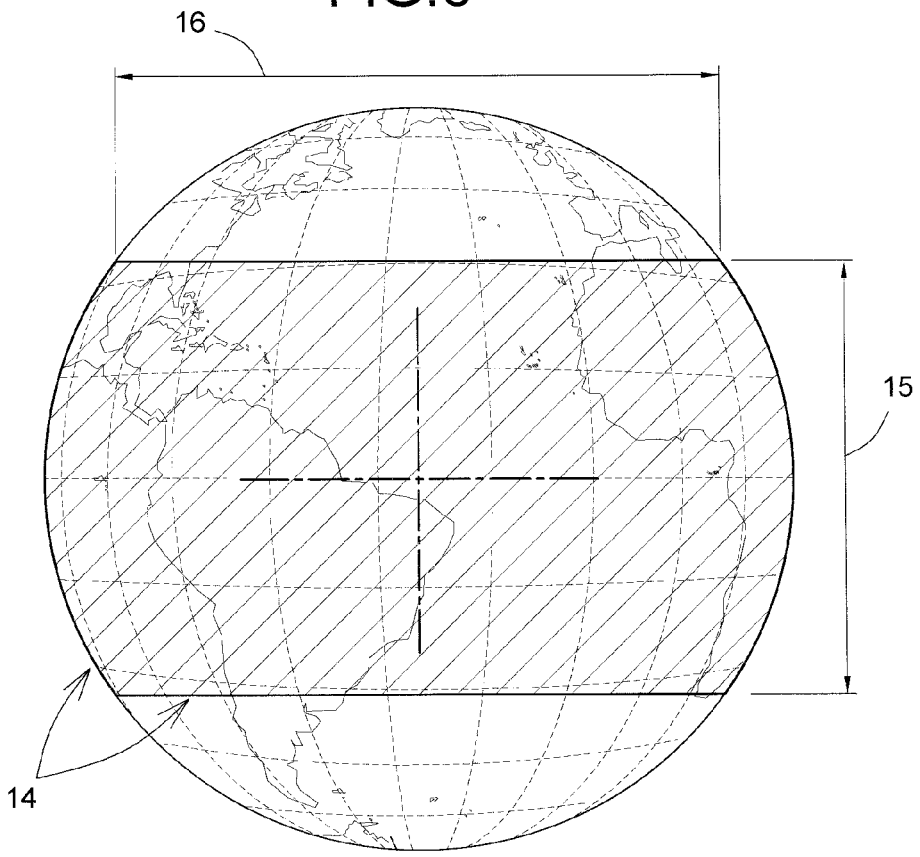
FIG. 7 is a schematic view of a typical coverage area for the embodiment of FIG. 3 mounted on a spacecraft, showing the narrowest and widest angular widths thereof.

Referring to FIGS. 3 and 3*a*, there is shown a steerable antenna 10 for allowing transmission and/or reception of an electromagnetic signal within an antenna coverage region 14, as shown by the shaded area in FIG. 7, over a predetermined surface, such as the surface of the Earth. The electromagnetic signal travels through a feed chain and between a feed source 18 and a target. The target moves within the antenna coverage region 14 in which the antenna signal beam 12 is to be steered.

Although the antenna 10 described hereinafter is mounted on the earth facing panel 24 or deck of a satellite pointing at the Earth surface (not shown) with the target being a specific location thereon, it should be understood that any other configuration of a similar antenna such as a ground antenna facing at orbiting satellites could be considered without departing from the scope of the present invention.

The antenna 10 includes a dual reflector system or assembly 26. The latter defines a sub-reflector surface 27 and a main reflector surface 28 for reflecting the electromagnetic signal between the feed source 18 and the target, and therefore generates the antenna signal beam 12 defining a beam axis 13. The sub-reflector surface 27 and main reflector surface 28 define a focal point 30 of the system 26. The feed source aperture center point is substantially located close or adjacent to the focal point 30 of the system 26. The feed source 18 is pointing substantially at the sub-reflector intersection point 32 such that the feed source axis 40 intersects with the focal point 30 and the sub-reflector intersection point 32. The portion of the electromagnetic signal reaching the main reflector surface 28 is reflected with a beam axis 13 at angle $\alpha$ from the feed axis 40. The angle $\alpha$ is at least as large as half of the angular width or direction of the narrowest dimension 15 of the coverage area 14 (see FIG. 7), thus defining a narrowest angular width of the coverage area 14.

A first rotating member, preferably a rotary actuator 42 or the like, rotates the dual reflector system 26 and feed source 18 about a first rotation axis RA1, extending generally perpendicularly to the feed axis 40 and not intersecting with the coverage area, and provides nominal signal gain steering along one direction over the coverage region 14. Preferably, the actuator 42 rotates the dual reflector system 26 and feed source 18 such that the beam 12 scans about the angular width 16 or direction of the widest dimension 16 of the coverage area 14 (see FIG. 7) thus defining a widest angular width, or along the main track of the target, between a first limit position $\theta_1$ a second limit position $\theta_2$, such as over a range of about 180 degrees.

Figure 4:
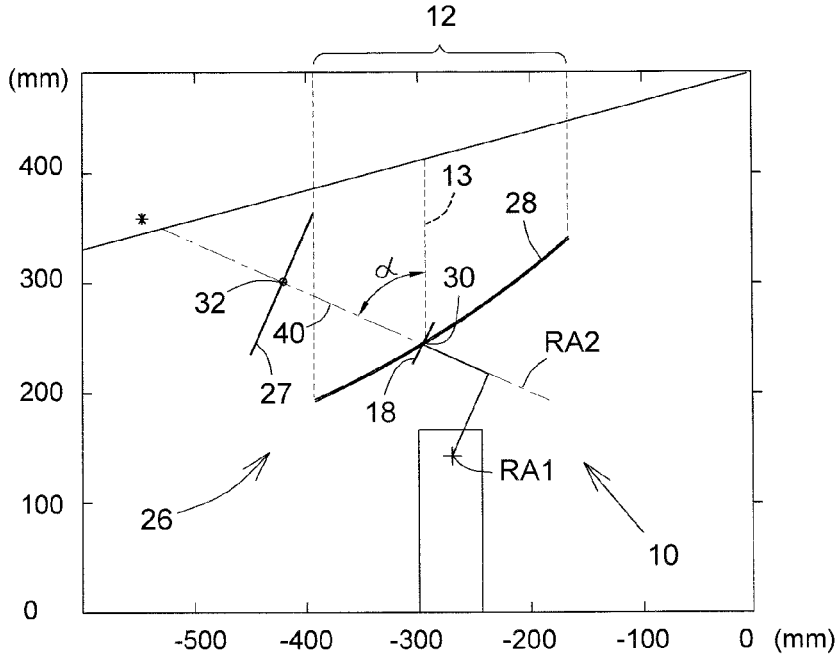
FIG. 4 is schematic view, showing the geometry of a steerable antenna in accordance with the embodiment of FIG. 3, with no key-hole singularity, and using a flat sub-reflector and a parabolic main reflector to generate the antenna signal beam.
Figure 5:
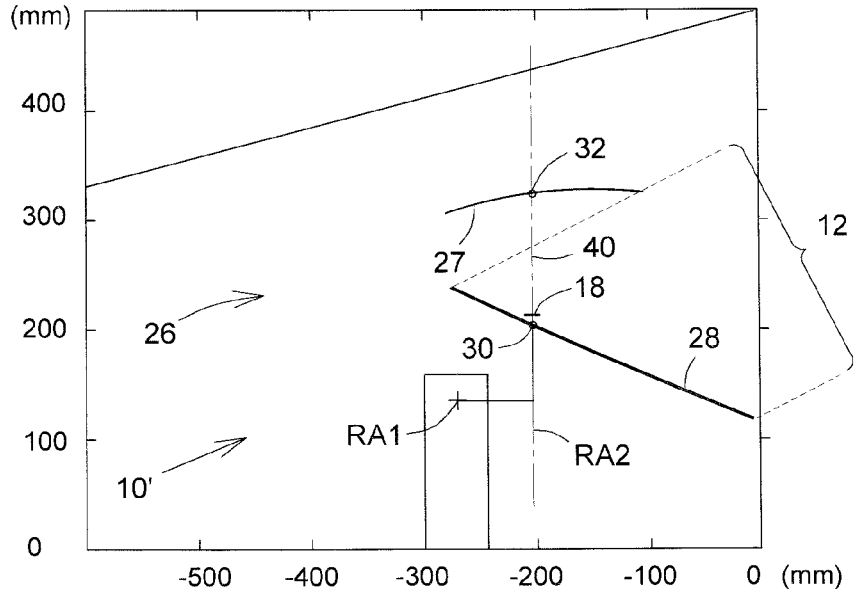
FIG. 5 is schematic view, showing the geometry of a steerable antenna in accordance with another embodiment of the present invention, with no key-hole singularity, and using a hyperbolic sub-reflector and a parabolic main reflector to generate the antenna signal beam.
Figure 6:
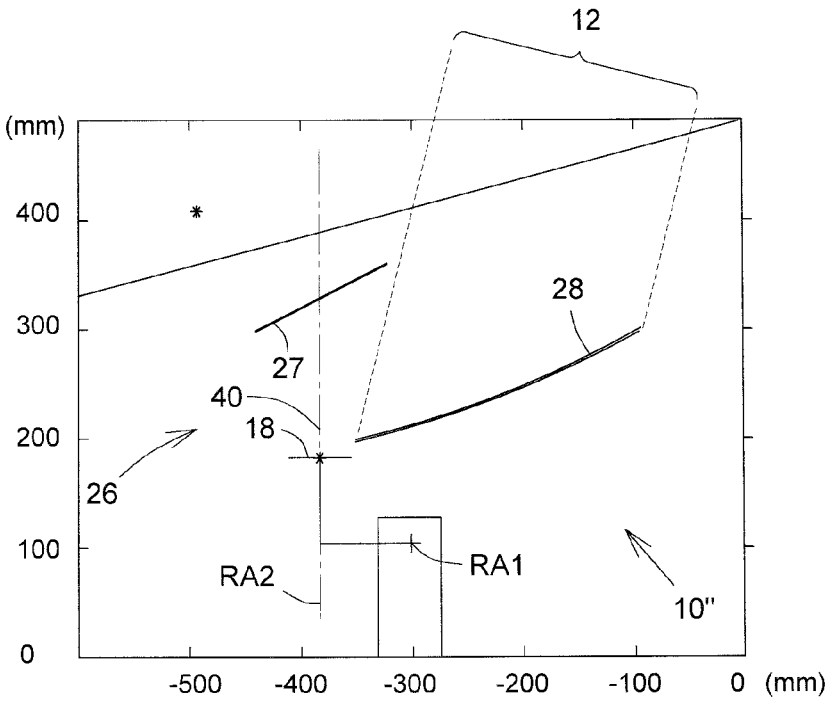
FIG. 6 is schematic view, showing the geometry of a steerable antenna in accordance with another embodiment of the present invention, with no key-hole singularity, and using a flat sub-reflector and a parabolic main reflector substantially offset from the feed axis to generate the antenna signal beam.

Typically, the nominal sub-reflector surface 27 and the main reflector surface 28 are each a section of a conical function surface, preferably a parabolic surface (as in the sub-reflector 27 of the embodiment 10' in FIG. 5 and in the main reflector 28 of embodiments 10, 10" in FIGS. 3 to 4 and 6), hyperbolic surface, ellipsoid or a flat surface (as in the sub-reflector 27 of the embodiments 10, 10" in FIGS. 3 to 4 and 6 and in the main reflector 28 of the embodiment 10' in FIG. 5). At least one of the nominal sub-reflector surface 27 and the main reflector surface 28 can be respectively shaped so as to achieve a signal gain pattern of the antenna assembly for substantially matching a predetermined signal gain pattern.

The antenna 10 further includes a second rotating member, preferably a rotary actuator 46 or the like, that rotates the dual reflector system 26 about a second rotation axis RA2, substantially aligned or collinear with the feed axis 40, between a first position $\phi_1$ and a second position $\phi_2$; whereby the beam 12 is scanned along an arc-shaped line over the coverage region 14. Typically, the rotary actuator 46 rotates over a range of at most about 180 degrees so as to remain away from any singularity, although it could physically span over 360 degrees. Preferably, the rotary actuator 46 rotates the dual reflector system 26 such that the beam 12 scans substantially about the narrowest angular width 15 of the coverage area. When the sub-reflector 27 is substantially axi-symmetrical around the feed axis 40, the rotary actuator 46 generally rotates only the main reflector 28, as it could have been done with an antenna configuration of FIG. 4.

The dual reflector system 26 and feed source 18, and typically the second rotary actuator 46, are rotated about a rotation axis RA1 extending generally perpendicularly to the feed axis 40 (RA2) and not intersecting with the coverage area, so that the antenna 10 provides a predetermined signal gain over the coverage region 14, with no singularity.

Although not described hereinabove, encoders or the like are preferably used for providing feedback on the angular positions $\theta$, $\phi$ of both RA1 and RA2 actuators 42, 46, respectively.

Although the steerable antenna has been described with a certain degree of particularity, it is to be understood that the disclosure has been made by way of example only and that the present invention is not limited to the features of the embodiments described and illustrated herein, but includes all variations and modifications within the scope and spirit of the invention as hereinafter claimed.

We claim:

1. A transmitting and/or receiving steerable antenna configuration for optimal beam steering of an electromagnetic signal over wide scan angles within a pre-determined coverage area of the antenna, said antenna configuration comprising:

a sub-reflector and main reflector assembly defining an antenna focal point located substantially adjacent to a reflecting surface of a main reflector;

transmitting and/or receiving signal feed chain having a signal source located adjacent to the antenna focal point and defining a feed axis substantially pointing towards a sub-reflector intersection point, the main reflector generating a signal beam having a beam axis defining a beam angle with the feed axis;

a first rotation member rotating the feed chain and the sub-reflector and main reflector assembly about a first rotation axis generally perpendicular to the feed axis and not intersecting with the coverage area; and a second rotation member rotating one of the main reflector and the sub-reflector and main reflector assembly relative to the signal feed chain about a second rotation axis substantially aligned with the feed axis, the second rotation member being rotated by the first rotation member.

2. An antenna configuration as defined in claim 1, wherein the beam angle is at least half of an angular width of a narrowest dimension of the pre-determined coverage area defining a narrowest angular width of the coverage area.

3. An antenna configuration as defined in claim 1, wherein the sub-reflector intersection point is located adjacent a geometrical center of a sub-reflector of the assembly.

4. An antenna configuration as defined in claim 1, wherein the main reflector surface and a surface of a sub-reflector of the assembly are corresponding sections of respective conical function surfaces.

5. An antenna configuration as defined in claim 4, wherein at least one of the main reflector surface and the sub-reflector surface is shaped so as to achieve a signal gain pattern of the antenna assembly for substantially matching a predetermined signal gain pattern.

* * * * *